US006073869A

United States Patent [19]

Schulz

[11] Patent Number: 6,073,869

[45] Date of Patent: Jun. 13, 2000

[54] FERRITE BOBBIN FORMED FROM TWO INDENTICAL FERRITE COMPONENTS

[75] Inventor: Detlef Schulz, Wallkill, N.Y.

[73] Assignee: Fair-Rite Products Corporation, Wallkill, N.Y.

[21] Appl. No.: 09/323,659

[22] Filed: Jun. 1, 1999

Related U.S. Application Data

[60] Provisional application No. 60/087,959, Jun. 4, 1998.

[51] Int. Cl.[7] ..... B65H 75/14

[52] U.S. Cl. ..... 242/118.7; 242/609.18

[58] Field of Search ..... 242/608.8, 608, 242/608.2, 608.6, 609.1, 118.7, 610.5

[56] References Cited

U.S. PATENT DOCUMENTS

| | | | |
|---|---|---|---|
| 382,091 | 5/1888 | Kelsea | 242/609.1 |
| 3,110,454 | 11/1963 | Dinu | 242/118.7 X |
| 3,339,861 | 9/1967 | Montesi | 242/118.7 |
| 3,606,195 | 9/1971 | Freeman et al. | 242/118.7 |
| 3,743,209 | 7/1973 | Anderson | 242/609.1 |
| 3,905,561 | 9/1975 | Kelch et al. | 242/609.1 |
| 3,942,741 | 3/1976 | Hussar et al. | 242/118.7 |
| 3,966,139 | 6/1976 | Terpak | 242/118.7 |
| 4,002,309 | 1/1977 | Ruiz-Barbotteau | 242/609.1 X |
| 4,244,535 | 1/1981 | Moodie | 242/608 X |
| 4,867,391 | 9/1989 | Resch | 242/609.1 X |
| 4,997,142 | 3/1991 | Grant | 242/118.7 |
| 5,251,841 | 10/1993 | Takatori et al. | 242/609.1 X |
| 5,464,171 | 11/1995 | Ripplinger | 242/609.1 |

FOREIGN PATENT DOCUMENTS

| | | |
|---|---|---|
| 1022222 | 3/1953 | France . |

*Primary Examiner*—John M. Jillions
*Assistant Examiner*—Collin A. Webb
*Attorney, Agent, or Firm*—Anthony J. Casella; Gerald E. Hespos

[57] ABSTRACT

A ferrite component is provided for forming a ferrite bobbin about which an electric conductor is wound. The component is formed with an enlarged flange portion from which extends a shaft portion that defines a free end. The free end of the shaft portion has at least one outwardly extending projection and at least one recessed hollow which are similarly shaped and dimensioned. Two of the ferrite components are mated together to form the bobbin with the projection of one component extending into the hollow of the other component and vice versa.

5 Claims, 3 Drawing Sheets

FERRITE BOBBIN FORMED FROM TWO INDENTICAL FERRITE COMPONENTS

This application claims priority on U.S. Provisional Patent Appl. Ser. No. 60/087,959, filed Jun. 4, 1998.

BACKGROUND OF THE INVENTION

1. Field of the Invention

The invention relates to components for forming ferrite elements and, more particularly, for forming a ferrite bobbin.

2. Background of the Invention

Ferrite bobbins are known in the prior art. The bobbins are generally spool shaped with two enlarged flange portions and a shaft extending between the flange portions about which an electric conductor is wound. Referring to FIGS. 1(*a*)–(*c*), a multi-component prior art ferrite bobbin 1 is shown therein. Specifically, the ferrite bobbin shown is Part No. 9677182209 manufactured by Fair-Rite Products Corporation, Walkill, N.Y., the assignee herein. As shown in FIG. 1, the ferrite bobbin 1 is formed from three separate components, namely, disc-shaped flanges 2, 3 and a shaft 4. In forming the ferrite bobbin 1, each individual component is separately prepared from ferrite, and then, assembled using glue. This design, although very simple, suffers from some drawbacks. First, as can be readily appreciated, attention must be paid to ensure the flanges 2 and 3, and the shaft 4 are in proper axial alignment during assembly. Also, as shown in FIG. 1(*b*), each of the flanges 2, 3 is formed with a pair of diametrically-opposed slots S. The slots S are used in facilitating winding of a wire about the ferrite bobbin 1, as well as, providing spaces for engaging support pins or locator pins on a circuit board. It is desired that the slots of both the flanges 2 and 3 be axially aligned to allow for proper cooperation with any pins. The flange portions 2, 3 however do not have an arrangement to ensure axial alignment and components are occasionally formed with the slots S being out of axial alignment.

In FIG. 2, Part No. 9677142009 sold by Fair-Rite Products Corporation is shown, which is representative of a second type of ferrite bobbin design. Referring to FIG. 2, a ferrite bobbin 5 is depicted which is unitarily formed from a single piece of ferrite material and shaped to define two enlarged flange portions 6, 7 and a central shaft 8. To prepare the ferrite bobbin 5, a slug of ferrite material is first formed which defines the same outer dimensions of the ferrite bobbin 5. By example, to form the ferrite bobbin 5, a slug would have to be provided having a rectangular profile with a width "W" extending between the outer faces 9, 10 of the flange portions 6 and 7, and a height $D_2$, as shown in dashed lines. The slug is then machined, e.g. by centerless plunge grinding, to form the shape of the ferrite bobbin 5 with the central shaft 8 having a reduced diameter $D_2$. As with all prior art ferrite bobbin designs, the flange portions 6, 7 and the central shaft 8 can be formed with circular shapes, as shown, or alternatively with various polygonal shapes. Although this second type of prior art design does not require any assembly, this design suffers from some drawbacks. First, the step of machining and the material waste produced by machining are undesired. Also, the machining process causes the flange portions 6 and 7 to each have a sharp inner edge 11. As a result, during the process of winding a wire on the ferrite bobbin 5, care must be exercised to ensure that the wire does not overly rub against the edges 11, resulting in the wire being cut, frayed or damaged in any other way. To avoid this problem, the edges 11 can be "broken" with a rounded or beveled shape, but to achieve this result, an additional manufacturing step is required in forming the ferrite bobbin 5.

It should be noted that a unitary ferrite bobbin cannot be readily formed directly from ferrite material. In particular, the process of forming a ferrite component such as a slug, disc, bead, and so on typically involves press compaction molding of ferrite material into the desired form. The shape of an entire bobbin, as shown in FIG. 1(*a*) and FIG. 2, cannot be press compaction molded. It should also be noted, entire ferrite bobbins have been unitarily manufactured from an injection molding process. However, injection molding requires the inclusion of a binder material in the ferrite prior to molding. With current binders, time consuming procedures are required to remove the binder from the molded ferrite component (e.g. submersion of the components in a chemical bath for a period of time). As is readily appreciated, the increase in size of injection-molded ferrite components results in an increase in the period of time and the amount of effort to be exerted required for binder-material removal. Thus, the process of injection molding ferrite bobbins has commercial and practical limitations, especially with respect to larger size ferrite bobbin components.

It is an object of the subject invention to provide components for easily and efficiently forming a ferrite bobbin.

SUMMARY OF THE INVENTION

The above-stated object is met by a component formed from ferrite to define a unitary body having a disc-shaped flange portion and a shaft portion extending therefrom. The free end of the shaft portion has a planar portion into which extends an elongated hollow, and from which extends an elongated projection. The hollow and the projection are preferably disposed at generally right angles relative to one another to define a cruciform shape. Additionally, the hollow and the projection preferably define similarly dimensioned trapezoidal cross-sections.

In forming a ferrite bobbin, two components of the subject invention are utilized and disposed so that the free ends thereof come into abutting contact with the projection of one component being disposed in mating engagement with the hollow of the other component and vice versa. Due to the interengagement of the projections and hollows, relative movement between the shafts of the two components is greatly limited or altogether prevented. Furthermore, the interengagement ensures proper axial alignment between the two components. The free ends of the two components are joined using any technique known by those skilled in the art, such as gluing, to form the ferrite bobbin.

Also, the component is formed using a press compaction technique. In preparing the dies for forming the component, appropriate corners and edges can be rounded and chamfered to reduce the possibility of wire failure during a wire winding procedure. Also, as is readily appreciated, the component requires no machining.

These and other features of the subject invention will be better understood through a study of the following detailed description and accompanying drawings.

DETAILED DESCRIPTION OF THE PREFERRED EMBODIMENT

Figure 1A:
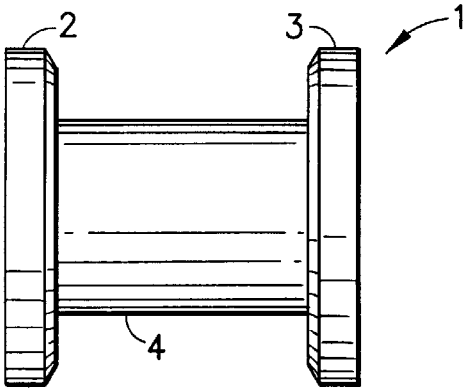
FIG. 1a PRIOR ART
FIGS. 1(*a*)–(*c*) show various views of a first type of prior art ferrite bobbin design.
Figure 1B:
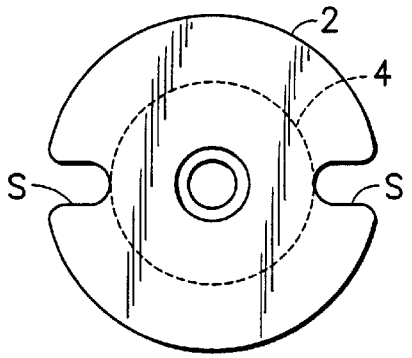
FIG. 1b PRIOR ART
Figure 1C:
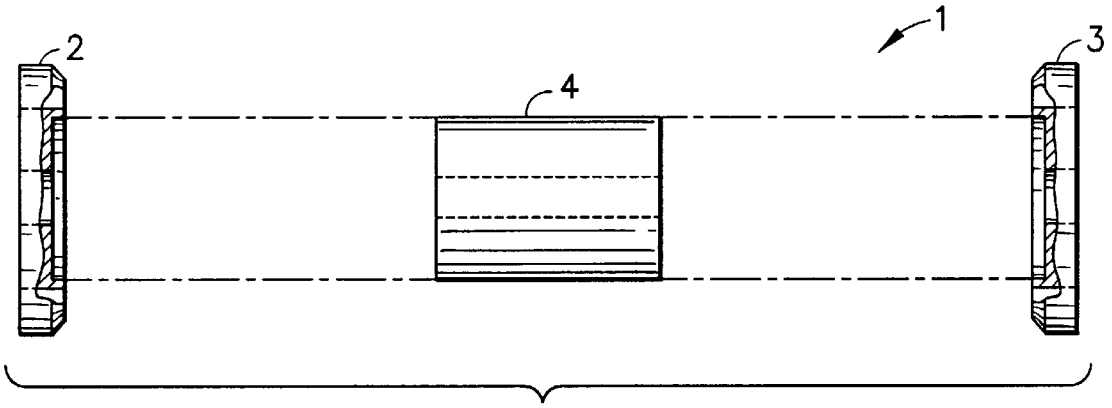
FIG. 1c PRIOR ART
Figure 2:
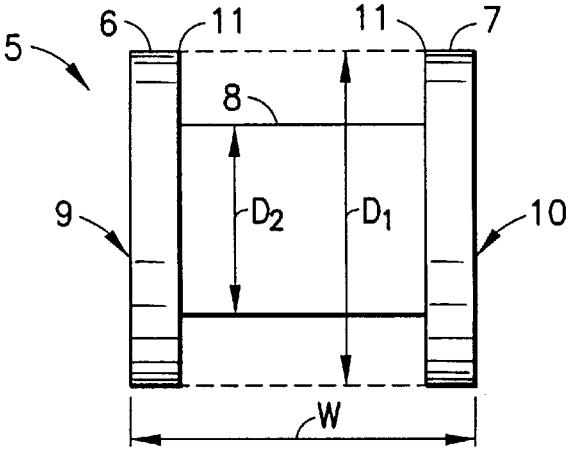
FIG. 2 PRIOR ART
FIG. 2 is a side view of a second type of prior art ferrite bobbin design.
Figure 3:
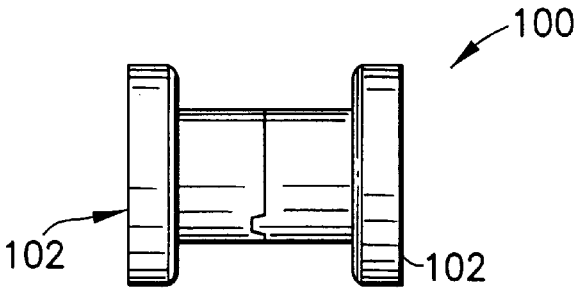
FIG. 3 is a side view of a ferrite bobbin formed by two components of the subject invention.
Figure 4:
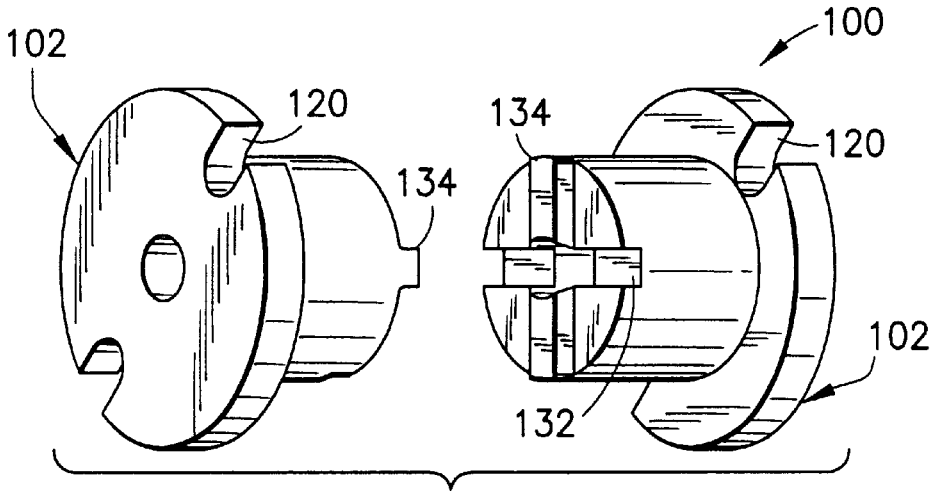
FIG. 4 is an exploded view of two components of the subject invention in alignment and ready for assembly.
Figure 5:
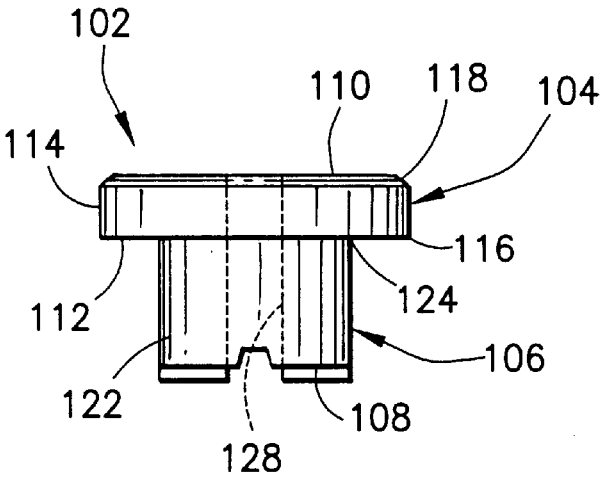
FIG. 5 is an elevational view of a component of the subject invention.

Referring generally to FIGS. 3 and 4, a ferrite bobbin 100 is shown formed from two identical ferrite components 102. As shown more clearly in FIGS. 5 and 6, each of the ferrite components 102 is formed with a flange portion 104 and a shaft portion 106. As described below, the shaft portion 106 defines a free end 108 which defines an interlocking arrangement shaped to homogamously cooperate with the free end 108 of a second component 102 in forming the ferrite bobbin 100. The free end 108 is spaced from and generally faces away from the flange portion 104. Also, the shaft portion 106 defines a smaller cross-sectional dimension at the free end 108 than the cross-sectional dimension defined by the flange portion 104. As used herein, "cross-sectional dimensions" are measured in planes substantially perpendicular to or perpendicular to the longitudinal axis of the ferrite component 102—i.e., substantially perpendicular to or perpendicular to the circumferential surfaces of the flange portion 104 and the shaft portion 106, as defined below.

The flange portion 104 is formed with an outer surface 110, an inner surface 112, and a circumferential surface 114. The edges joining the surfaces 110–114 are preferably formed to not define a sharp corner. It is preferred that the edge 116 joining the inner surface 112 and the circumferential surface 114 be rounded. Also, edge 118 which joins the outer surface 110 and the circumferential surface 114 may be chamfered. Slots 120 are formed into the flange portion 104 which are located at diametrically opposed locations to accommodate the end or ends of a wire which is to be wound about the ferrite bobbin 100. Also, the slots 120 are shaped and dimensioned to register with locator pins or support pins formed on a circuit board. As such, with a wire being wrapped about the ferrite bobbin 100, the assembly may be securely supported on a circuit board.

The shaft portion 106 is integrally formed with the flange portion 104 and extends from the inner surface 112. The shaft portion 106 is formed with a circumferential surface 122. A corner 124 is defined at the intersection of the inner surface 112 and the circumferential surface 122 and is preferably rounded. A channel 128 extends from the free end 108 to the outer surface 110. The channel 128 is dimensioned to accommodate a mandrel of a wire winding apparatus. As an alternative embodiment, although not shown, the channel 128 may be formed to only partially extend into the ferrite component 102 from the outer surface 110—i.e., the channel 128 is formed as a blind hole rather than a through hole.

Figure 6:
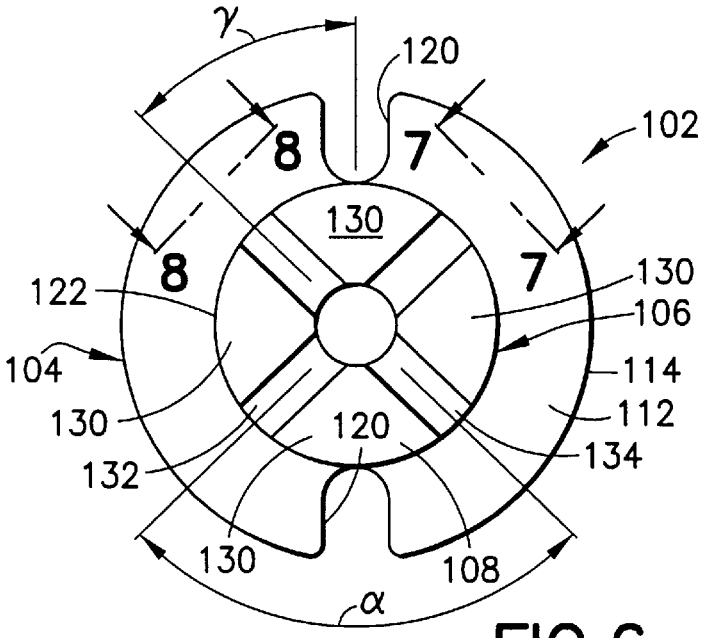
FIG. 6 is a top view of a component of the subject invention.

In the figures, the flange portion 104 and the shaft portion 106 both define a circular shape, as shown most clearly in FIG. 6. The flange portion 104 and/or the shaft portion 106 may also be formed with a polygonal profile, such as a rectangle.

The free end 108 is formed with four circumferentially-spaced wedge-shaped planar portions 130. The planar portions 130 are preferably disposed to lie in the same plane, that plane being generally perpendicular to the longitudinal axis of the shaft portion 104. An elongated hollow 132 and an elongated projection 134 are defined in the free end 108 and are preferably arranged in a cruciform pattern to space the planar portions 130 apart. As shown in FIG. 6, the hollow 132 and the projection 134 extend across the free end 108, but are interrupted by the channel 128. To form the cruciform pattern, the hollow 132 and the projection 134 define an angle $\alpha$ of 90° therebetween.

Figure 7:
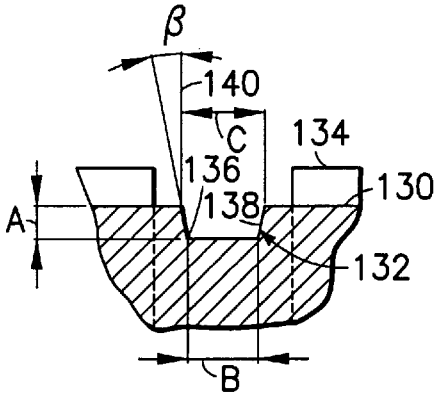
FIG. 7 is an enlarged partial view of a section taken along line 7—7 of FIG. 6 showing a hollow formed in a component of the subject invention.
Figure 8:
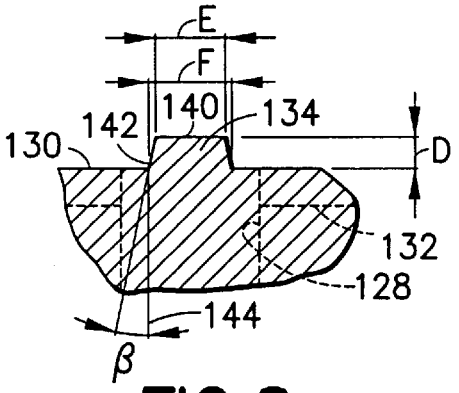
FIG. 8 is an enlarged partial view of a section taken along line 8—8 of FIG. 6 showing a projection formed on a component of the subject invention.

For the ferrite component 102 to mate with a second of the components 102 and form the ferrite bobbin 100, the hollow 132 and the projection 134 must be formed with cooperating mirror-image shapes. It is preferred that both the hollow 132 and the projection 134 be formed with a trapezoidal cross-section, as shown in FIGS. 7 and 8. To ensure proper mating of the components 102, the hollow 132 is formed with a base 136, which is recessed below the planar portions 130 a distance "A", and two side walls 138 which are disposed at an acute angle $\beta$ relative to an axis 140 disposed perpendicularly to the planar portions 130. Further, the base 136 defines a width "B", and the hollow 132 also defines a dimension "C" in a plane coplanar with the planar portions 130. With reference to FIG. 8, the projection 134 is formed with a top surface 140 and two side walls 142. The top surface 140 is spaced a distance "D" from the planar portions 130, and the top surface 140 has a width of dimension "E". Further, the projection 134 defines a width "F" at the base thereof in a plane which is coplanar with the planar portions 130. As is readily apparent, the base 136 of the hollow 132 is located at a shorter distance from the flange portion 104 than the top surface 140.

To ensure the mating of the hollow 132 of one of the ferrite components 102 and the projection 134 of a second of the ferrite components 102, the dimensions A–C of the hollow 132 are to be made slightly greater than the corresponding dimensions D–F of the projection 134. In particular, the dimension A is slightly greater than dimension D, dimension B is slightly greater than dimension E, and dimension C is slightly greater than dimension F. The side walls 142 of the projection 134 are preferably disposed at the same acute angle $\beta$ relative to an axis 144 which is perpendicular to the planar portions 130.

As alternative embodiments, the hollow 132 and the projection 134 may be formed with other cross-sectional shapes. For example, both the hollow 132 and the projection 134 may define semi-circular or rectangular cross-section (not shown). Regardless of the specific shape, the hollow 132 and the projection 134 preferably define the same cross-sectional shape, and the hollow 132 is preferably dimensioned slightly greater than the projection 134. It should be noted that manufacturing techniques may influence the shape of the hollow 132 and the projection 134. For example, it has been found that utilizing a trapezoidal cross-section for the hollow 132 and the projection 134 in conjunction with press compaction molding in forming the component 102 results in good material adhesion in the hollow 132 and the projection 134, generally without manufacturing imperfections.

With reference to FIG. 4, the ferrite bobbin 100 is formed by assembling two of the ferrite components 102. Specifically, the two ferrite components 102 are aligned to allow for the mutual mating of the hollows 132 and the projections 134 of the two ferrite components 102. The interengagement of the hollows 132 and the projections 134 ensures repeated axial alignment of the two ferrite components 102. Additionally, the interengagement ensures repeated alignment of the slots 120 of the two ferrite components 102. To ensure proper axial alignment of the slots 120 between the two ferrite components 102, it is preferred that the center of the slots 120 be disposed at an angle γ of 45° relative to the projection 134, as shown in FIG. 6. Any technique known by those skilled in the art, such as gluing, may be used to secure together the two ferrite components 102 in forming the ferrite bobbin 100.

As is readily apparent, numerous modifications and changes may readily occur to those skilled in the art, and hence it is not desired to limit the invention to the exact construction and operation shown and described and, accordingly, all suitable modification equivalents may be resorted to falling within the scope of the invention as claimed.

What is claimed is:

1. A ferrite bobbin formed from two identical components, each said component comprising:

a ferrite, disc-shaped flange portion having spaced-apart first and second axial ends and a peripheral surface extending therebetween, said flange portion having slots formed at diametrically opposed locations to facilitate the winding of wire and to provide a passage for support pins; and a ferrite shaft portion extending from and being unitarily connected to said first axial end of said flange portion, said shaft portion defining a free end spaced from and generally facing away from said first axial end of said flange portion, wherein said free end is formed to define at least one planar portion, at least one projection extending beyond said planar portion and away from said flange portion, and at least one hollow recessed below said planar portion in a direction towards said flange portion, wherein said projection and said hollow are formed with substantially identical cross-sectional shapes, wherein said flange portion defines a first cross-sectional dimension, said shaft portion defines a second cross-sectional dimension at said free end, said second cross-sectional dimension being less than said first cross-sectional dimension, whereby said free end of said component is mated with a second like component in an intimate engagement to form the ferrite bobbin and to ensure proper axial alignment between said components and said slots.

2. A ferrite bobbin as in claim 1, wherein said projection and said hollow of said component are both formed with a trapezoidal cross-section.

3. A ferrite bobbin as in claim 1, wherein said free end of said component is formed to define a first portion located a first distance from said first axial end of said flange portion of said component, and wherein said free end is formed to define a second portion located a second distance from said first axial end of said flange portion, said first distance and said second distance being different.

4. A ferrite bobbin as in claim 1, wherein said free end of said component defines an elongated hollow disposed perpendicularly to an elongated projection in a cruciform arrangement.

5. A ferrite bobbin as in claim 1, wherein a channel extends from said second axial end of said flange portion of said component towards said free end of said component.

* * * * *